United States Patent [19]

Fredman et al.

[11] 4,080,674

[45] Mar. 28, 1978

[54] BED RAILS WITH CENTER BAR SUPPORT

[76] Inventors: Harry Fredman; Irving Fredman, both of 908 SW. Washington St., Peoria, Ill. 61602

[21] Appl. No.: 758,697

[22] Filed: Jan. 3, 1977

[51] Int. Cl.[2] ..... A47C 19/12

[52] U.S. Cl. ..... 5/310; 5/200 R; 5/203

[58] Field of Search ..... 5/176, 177, 181, 200 R, 5/201-203, 211, 238, 296, 305, 310

[56] References Cited

U.S. PATENT DOCUMENTS

| | | | |
|---|---|---|---|
| 2,857,602 | 10/1958 | Quintana | 5/286 |
| 3,736,602 | 6/1973 | Miller | 5/176 R |
| 3,810,264 | 5/1974 | Mueller | 5/310 |
| 3,961,381 | 6/1976 | Weinhart | 5/286 |

*Primary Examiner*—Casmir A. Nunberg
*Attorney, Agent, or Firm*—Clarence A. O'Brien; Harvey B. Jacobson

[57] ABSTRACT

A pair of longitudinally extending bed rails having a center cross bar interconnecting the rails with a depending supporting leg adjacent each end of the cross bar for providing support adjacent the center of the bed rails. The bed rails include a vertical flange and a horizontal flange with the horizontal flange extending under and forming a support for a substantial length of the bedding assembly, such as the box spring, with the cross bar pulling the rails inwardly into contact with the sides of the box spring. The cross rails are provided with a tongue and slot connection with the horizontal flanges of the side rails to enable assembly and disassembly of the cross bar in relation to the side rails. The depending supporting legs on the cross bar each are provided with a vertically adjustable glide on the lower end thereof for enabling the cross bar to be used with bed rails supported at different elevations in relation to a supporting surface in order to accommodate various vertical pin orientations in the headboard and footboard. The tongue and slot interconnection is recessed below the supporting surface of the horizontal flange of the bed rails so that the inner longitudinal wood frame member of the box spring will rest flat against the upper surface of the horizontal flange of the bed rails, thereby eliminating bending, warping and possible damage to the wood frame of the box spring.

12 Claims, 3 Drawing Figures

BED RAILS WITH CENTER BAR SUPPORT

BACKGROUND OF THE INVENTION

1. Field of the Invention

The present invention generally relates to a bed construction and more particularly to bed rails adapted for use in supporting queen size bedding or other large standardized sizes of bedding. For example, in a queen size bed, the standard width size is 60 inches but the bedding or box spring is normally 59½ to 60 inches in width and the end boards (or the spacing between the slots therein) are normally 60 to 61 inches wide. Further, the larger sized bedding, such as queen size, is also being constructed longer, thus requiring longer bed rails, such as 82 inch rails. A center cross bar interconnects the bed rails and is provided with vertically adjustable supporting leg assemblies at each end thereof adjacent the center of the side rails with the cross bar pulling the side rails into snug supporting engagement with the box spring and the supporting leg assemblies providing support for the bed rails to prevent downward sagging or deflection of the side rails.

2. Description of the Prior Art

Numerous structures relating to beds and bed rails have been required with the conventional bed rails requiring longitudinally spaced, transversely extending wooden or metal slats extending therebetween. Such rails sagged or deflected under the weight of the box spring and other bedding components which allowed the box spring to sag. This especially became a problem when wider span beds, such as 60 inch standard width, intead of 54 inch, bedding is used since the wider bedding is heavier as well as being wider and longer. Slats setting on angle iron or wood rails not only pushed the rails downward but also pushed the rails outwardly when weight was placed on the slats. This is a critical problem as the twisting or torquing of the rails frequently caused the bed legs to split when the slot in the legs of the beds is too close to the outside edge of the leg, or caused the bed legs to split away from the end board.

In prior U.S. Pat. No. 3,118,151, issued Jan. 21, 1964, bed rails which eliminate the use of transverse slats are disclosed and are interconnected by a centrally located cross member interconnecting the bed rails for pulling the bed rails inwardly into snug embracing engagement with the box spring so that the inwardly extending horizontal flange on the bed rails will support the box spring through a substantial portion of its length. Prior Pat. No. 3,761,970, issued Oct. 2, 1973, discloses bed frames and bed supporting structures in which the side rails are snugly engaged with the box spring so that the horizontal flanges provided on the opposed rails will extend under the box spring for a substantial portion of the length thereof. Also, in Hollywood bed frames, which are usually self-supporting independent of an end board, supporting leg assemblies are sometimes used in the central area of the self-supporting frame. However, Hollywood bed frames normally provide a rigid supporting frame which underlies the box spring or bedding and often include upwardly extending clips to retain the box spring on top of the rigid frame which is a different arrangement from bed rails extending between supporting legs on a headboard and footboard.

SUMMARY OF THE INVENTION

The present invention provides bed rails in combination with a pair of end boards which have a center cross bar extending transversely of the bed rails with the ends of the center cross bar connected to the bed rails. The center cross bar is provided with vertically adjustable support means for contacting a support surface to support the cross bar and central portion of the supporting rails in a manner to prevent sagging of the box spring and vertical deflection, horizontal deflection and twisting or torquing of the bed rails.

The principal object of the present invention is to provide bed rails interconnected by a cross bar with vertically adjustable supporting leg assemblies such that the bed rails are pulled into snug engagement with a box spring over a substantial portion of its length to provide firm support for the box spring along its bottom side edges and underneath center portion without utilizing transverse slats.

Another object of the invention is to provide bed rails interconnected by a cross bar with supporting leg assemblies to engage with a floor or other supporting surface in order to prevent downard deflection of the side rails and cross bar thus eliminating outward and downward twisting of the side rails and sagging of box spring.

A further object of the invention is to provide bed rails with an interconnecting cross bar in which the connection between the cross bar and bed rails is recessed downwardly below the supporting surface of the bed rails thereby avoiding bending or warping of, or other damage to, a box spring or other bedding component supported on the side rails.

Yet another object of the invention is to provide bed rails interconnected by a centrally oriented cross bar in which the cross bar has its ends detachably connected to the bed rails by a tongue and slot interconnection thus enabling assembly and disassembly of the cross bar with the bed rails without the use of external fastening devices or tools.

A further significant object of the present invention is to provide bed rails and a centrally disposed cross bar having vertically adjustable supporting leg assemblies adjacent each end of the cross bar in which the leg assemblies each include a vertically adjustable glide at the lower end thereof for engaging a floor or other supporting surface.

An additional object of the present invention is to provide bed rails interconnected by a centrally disposed cross bar having supporting means connected thereto which is relatively inexpensive to manufacture, easily and rapidly set up and yet dependable and long lasting as well as being trouble free in use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
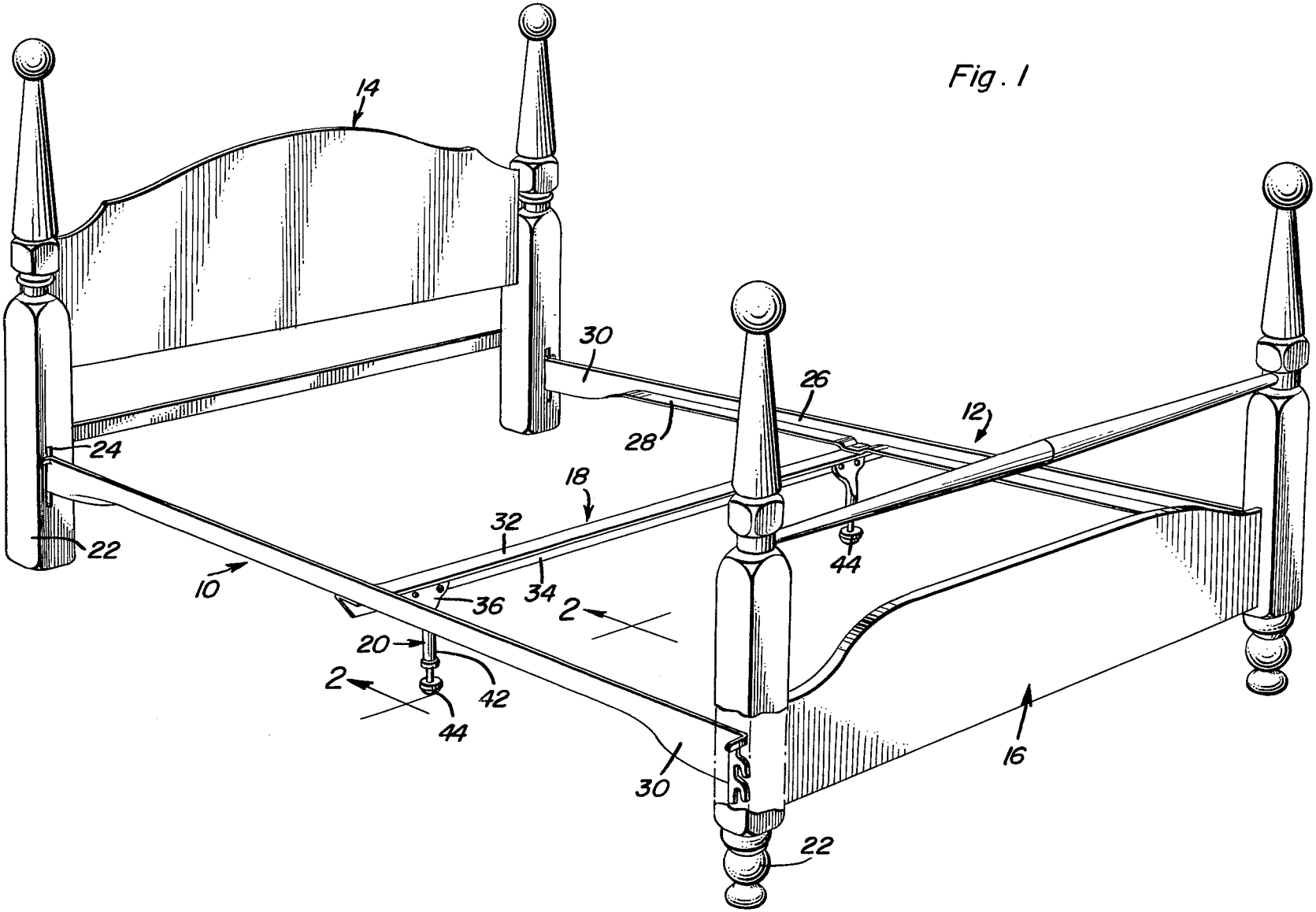
FIG. 1 is a perspective view of the bed rails and cross bar of the present invention associated with a headboard and footboard.

Referring now specifically to the drawings, bed rails 10 and 12 are illustrated as extending between a headboard 14 and a footboard 16 and the central portion of the bed rails 10 and 12 are interconnected by a cross bar generally designated by numeral 18. The cross bar includes a pair of supporting leg assemblies 20 with a leg assembly 20 being disposed adjacent each end of the cross bar 18. The headboard 14 and footboard 16 are of conventional construction and may have any desired appearance characteristics with each end of the end boards including a supporting leg 22 provided with a vertical slot 24 in the inner surface thereof for receiving the projecting hooks on the end of the bed rails 10 or 12 with vertically spaced transverse pin extending across the slot 24 receiving said hooks which is a conventional and well known manner of connecting bed rails to end boards. This particular construction forms no particular part of the present invention except that the legs 22 on the headboard and footboard provide a support for the rails 10 and 12 and the bedding assembly thereon in a well known and conventional manner. For further understanding of this particular construction, reference is made to prior U.S. Pat. No. 3,118,151, which illustrates further structural details of the manner in which the bed rails are supported by the end boards.

As illustrated, each of the bed rails is of one-piece construction and includes a vertical flange 26 and a horizontal flange 28 extending inwardly from the lower edge of the vertical flange, with the flanges 26 and 28 forming a right angle cross section over a major portion of the length of each rail. The end portions of the rails 10 and 12 are in the form of a generally vertical plate structure 30 which provides for limited lateral flexing of the right angle portion of the bed rails, and also to accommodate variations in the width between the slots 24 which occurs during normal manufacturing procedures. In other words, in a queen size bed, the bedding manufacturers have standardized the box spring width at 60 inches , and the width normally varies between 59½ and 60 inches. In contrast, the bed manufacturers have not standardized end board widths, and the spacing between the slots normally vary from 60 inches to 61 inches and even to as much as 62 inches. Thus, the lateral flexibility of the end portions allows the ends of the rails to be mounted on end boards having, say, a 61 inch spacing and the central portions drawn inwardly to the 59½ or 60 inch spacing to engage the bottom edges of the queen size box spring.

Further, while each rail is shown as of unitary construction, it is contemplated for my invention that the right angle portion comprising flanges 26 and 28 can be conventional angle iron with the generally vertical plate end portions 30 welded, riveted or otherwise attached at the ends of the angle iron portion. So long as each side rail is made of generally rigid materials, such as steel or the like, with a right angle portion over a major portion of its length and a hook member on each end to accommodate a lateral movement of the central portion of the rails into snug contact against the side and underneath the box spring, it is within the concept of this invention. For example, the end portions shown as 207 in FIG. 17 of earlier U.S. Pat. No. 3,761,970, or the end portion shown as 40 in earlier U.S. Pat. No. 3,644,948, as well as even the end portions shown in U.S. Pat. No. 2,719,309, could be used with a conventional angle iron central portion in the combination of the present invention without departing from the invention.

Figure 3:
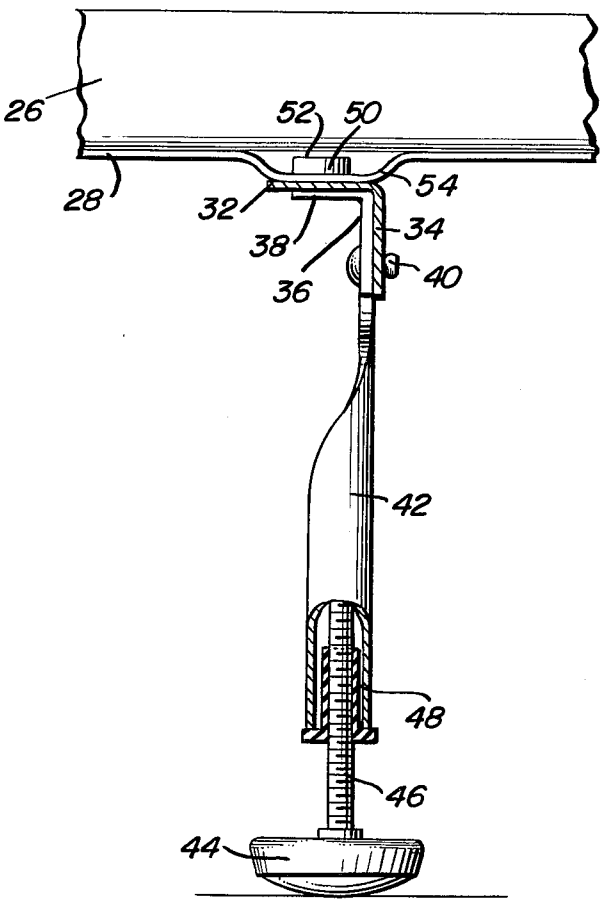
FIG. 3 is a vertical sectional view taken substantially upon a plane passing along section line 3—3 of FIG. 2 illustrating further structural details of the cross bar and the interconnection with the side rail.
Figure 2:
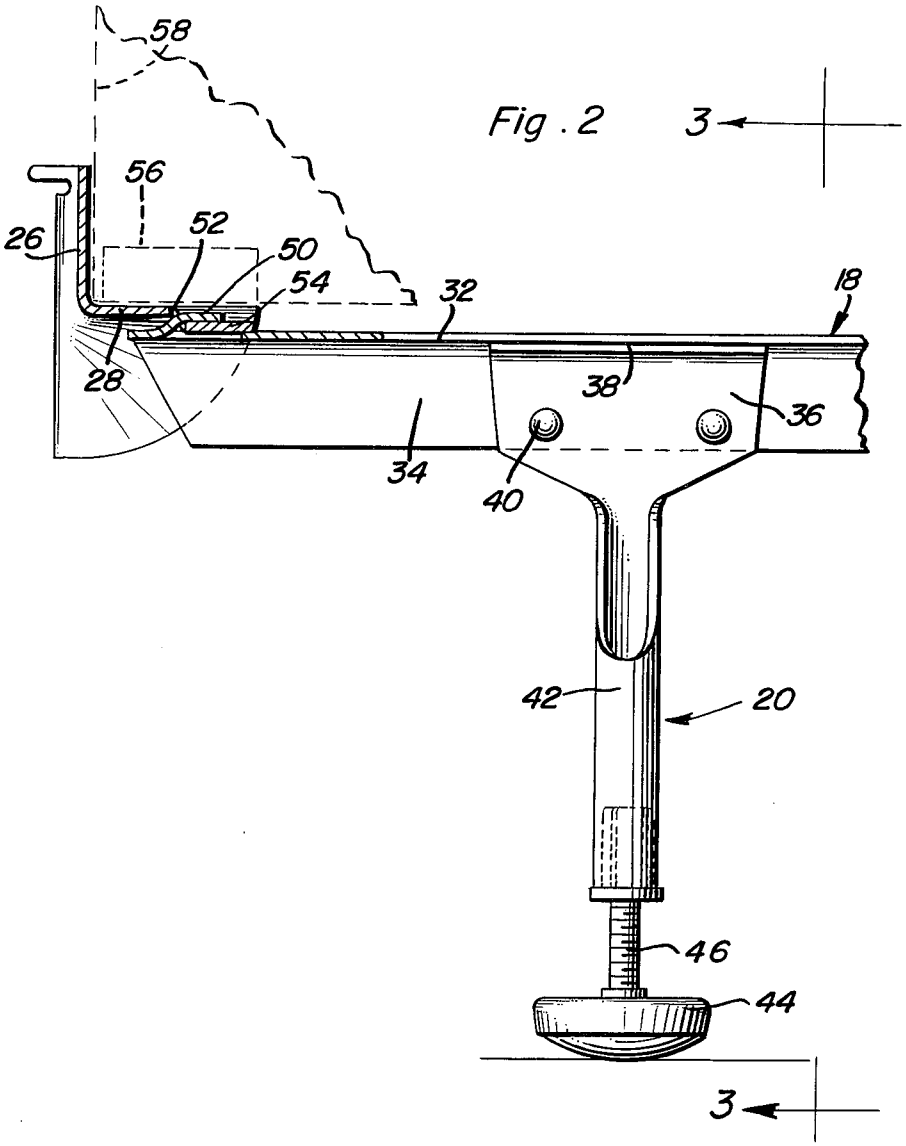
FIG. 2 is a vertical sectional view taken substantially upon a plane passing along section line 2—2 of FIG. 1 illustrating the specific structural details of the connection between the cross bar and side rail as well as the association between the bed rail, cross bar and box spring.

The cross bar 18 includes a horizontal flange 32 and a depending vertical flange 34 at one edge thereof thus forming a right angle member in which the horizontal flange 32 forms the top of the cross bar 18. Each supporting leg assembly 20 includes a bracket 36 in the form of a plate disposed against the surface of the vertical flange 34 of the cross rail 18 which has the horizontal flange 32 projecting therefrom with the upper edge of the bracket 36 including a horizontal flange 38 abutting against the undersurface of the horizontal flange 32 to support and rigidify the flange 32, as illustrated in FIGS. 2 and 3. The bracket 36 is rigidly and fixedly secured to the flange 34 by rivets 40 or other suitable fastening means. The lower end edge of the bracket 36 projects below the flange 34 and is formed into a depending tubular member 42 which supports a floor engaging glide 44 at the lower end thereof in which the glide includes a threaded steam or shank 46 projecting upwardly therefrom and in screw threaded and thus adjustable engagement with an insert 48 extending into the depending tubular member 42 which not only secures the glide assembly in place but also provides vertical adjustment by threading the stem or shank 46 into or out of the insert 48. This arrangement provides for vertical adjustment of the cross bar 18 so that the cross bar will be effectively supported even though the vertical heighth of the bed rails 10 and 12 may vary depending upon the particular construction of the headboard or footboard and the particular vertical orientation of the supporting pins which engage the hooks on the end of the bed rails.

The insert 48 is in the form of a tubular plastic member having a circular flange at its lower end and longitudinally tapering ribs on its external surface for frictionally locking the insert 48 in place in the tubular leg 42. The threaded stem 46 extends up through the insert and is in threaded engagement therewith with the plastic material of the insert and its memory characteristics serving not only to retain the insert in the tubular leg 42 but also frictionally to prevent free rotational movement of the threaded stem 46, but yet the stem 46 may be manually rotated by gripping the glide 44 which is rigid with the stem 46.

The connection between the cross bar 18 and each of the bed rails 10 and 12 is in the form of an upwardly struck tongue 50 on the horizontal top flange 32 of the cross bar 18 in which the free end of the tongue faces inwardly toward the center of the cross bar. The horizontal flange 28 of each side rail is provided with a longitudinal slot 52 and a downwardly offset portion 54 which receives the tongue 50, thus providing an interlocking but detachable connection between the cross bar 18 and the side rails. The tongue 50 has a major portion of its length parallel to the horizontal flange 32 and the offset portion 54 has a major portion of its length parallel to the flanges 28 and 32 with the tongue 50 being upwardly offset in relation to the flange 32 and the portion 54 being downwardly offset so that the interconnection between the cross bar and the bed rail does not provide any projection above the upper or supporting surface of the horizontal flange 28. The top of flange 32 is in direct contact with the bottom surface of offset portion 54 to provide a rigid and stable connection. This arrangement enables the longitudinal wood frame member 56 forming a portion of a box spring 58 to rest on a continuous flat surface formed by the flange 28. Also, the cross bar 18 is constructed so that when the connection between the cross bar and the side rails is made, the side rails 10 and 12 are in snug embracing engagement with the box spring 58, that is, the inner surface of the vertical flange 26 is disposed against the outer side surface of the box spring 58, thus providing a rigid unit in which a portion of the length of each of the side rails snugly engages both the horizontal and vertical edge portions of the box spring, whereby the headboard, box spring and bed rails, in effect, become a unitized structure so that the bed may be easily moved and the side rails will always remain in substantially perpendicular relation to the headboard and footboard.

The angle iron rails 10 and 12 are substantially rigid throughout the major portion of their length because of the right angle orientation of the flanges 26 and 28 but the relatively short plate-type end portions 30 enables some lateral flexing of the bed rail in this area. This enables the bed rails to attain a supporting relationship with the bottom corner portions of the box spring 58 and enables the hooks on the ends of the bed rail to be engaged with slots and pins therethrough in the headboard and footboard in which the horizontal distance between the slots 24 may vary from optimum spacing due to manufacturing tolerances.

The cross bar 18 retains the bed rails 10 and 12 in snug engagement with the box spring and prevents outward deflection thereof and also prevents twisting or torquing of the bed rails. The supporting leg assemblies 20 prevents the bed, the cross bar and the box spring thereon from sagging since the leg assemblies provide a firm support and contact between the cross bar and the two inside wood pieces that form the base of the frame of the box spring and which run lengthwise in the foundation of the box spring. The support of the bed rails by the cross bar 18 and leg assemblies protects the legs 22 of the bed since the bed rails cannot twist downward and outward because of their support from a point below and inwardly of the bed rails. In conventional bed structures, since the slots 24 are quite frequently rather close to the outer edge of the legs 22, it sometimes occurs that the downward and outward twisting of the bed rails will cause the leg 22 to split, or the legs to separate from the main portion of the end board, especially if it is constructed of wood.

The cross bar and depending leg assemblies combined with the bed rails engaged with the box spring provide a firm interlocked unit of rails and box spring which facilitates movement of the bed since it moves as a unit. The tongues at either end of the cross bar are disposed in the downwardly offset or depressed area of the rail thereby avoiding any possibility of the tongue tearing or otherwise damaging the box spring. It is within the purview of the present invention for other interconnecting means to be provided between the cross bar and side rails either detachable or permanent and either recessed or not. For example, the cross bar could be constructed of two angle iron members pivotally riveted to the respective flanges 28 so that the angle iron members could be swung from a position alongside of the bed rail to a position perpendicular thereto and adjustably connected at their overlapping inner ends by a suitable clamping device.

The vertical adjustment of the glide enables the glide to reach the floor on various beds in which the bottom pin in the slot of the bed leg may be at a variable heighth from the floor depending upon manufacturing tolerances, and the like. The leg assemblies 20 are set inwardly from the ends of the cross bar and sufficiently inwardly from the side of the bed so that they do not form an obstacle to be engaged by a person's foot, or the like, and the leg assemblies are set back sufficiently that they are hardly ever seen. The large glide 44, of nylon, or the like, has a relatively large and relatively flat surface for engaging carpeting or flooring without damage thereto. The tongue on the cross bar has a relatively large flat surface overlapping and engaging a large area of the depressed portion thereby reducing any possibility of play or looseness between the horizontal flange and the cross bar. The vertical ends of the flange 34 of the cross bar are cut at an angle of approximately 45 degrees to eliminate sharp corners or points that could possibly injure a person's foot or leg when making up the bed, cleaning or the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A bed construction comprising a pair of end boards, a box spring and a pair of side bed rails mounted on the end boards extending generally in parallel relation to each other with each of the rails including an inwardly extending horizontal flange, and a vertical flange over a major portion of its length, a single cross bar interconnecting said rails and disposed generally in perpendicular relation thereto, and supporting leg means mounted on said cross bar for supporting the cross bar and the bed rails to prevent downward sagging of the bed rails and box spring supported thereon with the cross bar preventing outward deflection of the bed rails as well as twisting of the bed rails, thereby providing a firm support for a box spring supported on the bed rails, said supporting leg means being disposed adjacent each of the bed rails and connected rigidly to the cross bar.

2. The structure as defined in claim 1 wherein each of said rails includes a vertical flange at the outer edge of the horizontal flange with the cross bar maintaining the vertical flange in snug engagement with a box spring supported solely on the horizontal flanges of the box rails thereby forming an interlocked unit of the bed rails and box spring, said supporting leg means on the cross bar including a pair of vertically disposed leg assemblies rigidly connected to said cross bar in longitudinally spaced relation, each leg assembly including a floor engaging member and means vertically adjusting the floor engaging member in relation to the cross bar to provide support for the cross bar and bed rails.

3. A bed construction comprising a pair of end boards, a box spring and a pair of side bed rails mounted on the end boards extending generally in parallel relation to each other with each of the rails including an inwardly extending horizontal flange, and a vertical flange over a major portion of its length, a cross bar interconnecting said rails and disposed generally in perpendicular relation thereto, and supporting leg means mounted on said cross bar for supporting the cross bar and the bed rails to prevent downward sagging of the bed rails and box spring supported thereon with the cross bar preventing outward deflection of the bed rails as well as twisting of the bed rails, thereby providing a firm support for a box supported on the bed rails, said cross bar including a top horizontal flange having a tongue adjacent each end thereof with each tongue having a free end edge facing inwardly, the horizontal flange in each bed rail including a slot structure receiving said tongue to enable assembly and disassembly of the cross bar with the side bed rails without the use of external fastening devices, tool, and the like, thereby facilitating set up of the bed construction.

4. The structure as defined in claim 3 wherein said horizontal flange on each bed rail is provided with a depressed portion forming the slot structure receiving the tongue thereby eliminating upward projections on the horizontal flange so that the horizontal flange will provide a smooth supporting surface for engagement with the box spring thereby preventing flexing, bending, or warping of the box spring.

5. The structure as defined in claim 4 wherein said tongue includes a substantially flat surface area spaced in parallel relation to the top flange of the cross bar for engagement with the depressed portion of the horizontal flange on the side bed rail with the upper surrface of the cross bar contacting the bottom surface of the depressed portion to stabilize the cross bar in relation to the side bed rail and prevent relative twisting therebetween.

6. The structure as defined in claim 5 wherein said cross bar includes a depending flange having a downwardly and inwardly inclined surface at each end edge to eliminate sharp points .

7. The structure as defined in claim 6 wherein each of said bed rails includes a vertical flange at the outer edge of the horizontal flange with the cross bar maintaining the vertical flange in snug engagement with a box spring supported solely on the horizontal flanges of the bed rails thereby forming an interlocked unit of the bed rails and box spring.

8. The structure as defined in claim 7 wherein said supporting means for the cross bar includes a pair of vertically disposed leg assemblies connected to said cross bar in longitudinally spaced relation, each leg assembly including a floor engaging member and means vertically adjusting the floor engaging member in relation to the cross bar to provide support for the cross bar and bed rails.

9. A bed which comprises a box spring, a headboard and a footboard each of which is provided with slots therein, a pair of bed rails interconnecting the headboard and footboard with supporting hooks extending into said slot, each of said rails including a vertical outer flange and an inwardly extending horizontal bottom flange with the vertical flanges receiving the box spring therebetween, a centrally disposed cross bar interconnecting said bed rails to pull the rails inwardly to maintain the horizontal flanges in underlying supporting engagement with the box spring and to pull the vertical flanges of the bed rails into snug engagement with the box spring over a substantial portion of its length along both bottom corners thereof with the cross bar preventing outward deflection of the rails and twisting of the rails about a longitudinal axis, and vertically adjustable support means on the cross bar for engaging a supporting surface to prevent downward sagging of the bed rails and cross bar, each end of the cross bar and each of the bed rails including detachable, interlocking, rigid connection to enable setup of the bed without the use of tools or application of external fasteners with the connection enabling the components to be transported in a compact, knockdown condition, said rigid connection including a horizontal tongue and slot connection interlockingly engageable in response to relative outward movement of the rails in relation to the cross bar and disengageable in response to relative inward movement of the rails in relation to the cross bar.

10. The bed as set forth in claim 9 wherein said support means includes a pair of vertical leg assemblies rigidly fixed to said cross bar adjacent to but inwardly spaced from the bed rails, each leg assembly including a vertically adjustable glide for engaging a floor surface, or the like, thereby enabling support to be provided to the cross bar and bed rails even though the supporting engagement between the bed rails and the headboard and footboard may vary vertically due to variation in height of the supporting pins.

11. The bed as set forth in claim 9 wherein said tongue and slot connection includes a longitudinally depressed portion in the inwardly extending bottom flange of each bed rail, a longitudinal slot formed along the edge of the longitudinal depression spaced from the inner edge of the horizontal flange of the bed rail with the slot being substantially straight and the portion of the depression aligned with the slot having a substantially flat under surface, said cross bar including a horizontal flange in underlying surface-to-surface engagement with the flat under surface of the depressed portion on the horizontal flange of the bed rail, said cross bar flange including an upwardly offset tongue having a free inner edge for insertion into the slot by relative horizontal outward movement of the bed rail in relation to the cross bar, said tongue having a substantially flat surface area engaging the upper surface of the depressed portion on the horizontal flange of the bed rail to provide a rigid connection with the surface-to-surface engagements stabilizing the cross bar flange with respect to the horizontal flange on the bed rail.

12. In a bed construction of the type comprising a pair of end boards, a box spring and a pair of side bed rails mounted on the end boards extending generally in parallel relation to each other with each of the rails including an inwardly extending horizontal flange, and a vertical flange over a major portion of the its length, that improvement comprising a cross bar adapted to interconnect said rails and adapted to be disposed generally in perpendicular relation thereto, and supporting leg means mounted on said cross bar for supporting the cross bar and the bed rails to prevent downward sagging of the bed rails and box spring supported thereon with the cross bar preventing outward deflection of the bed rails as well as twisting of the bed rails, thereby providing a firm support for a box spring supported on the bed, said cross bar including a top horizontal flange having a tongue adjacent each end thereof with each tongue having a free end edge facing inwardly, the horizontal flange in each bed rail including a slot structue receiving said tongue to enable rigid interlocking assembly in response to relative inward horizontal movement of the tongue or relative outward horizontal movement of the slot and disassembly of the cross bar with the side bed rails in response to relative outward horizontal movement of the tongue or relative inward horizontal movement of the slot structure and without the use of external fastening devices, tools, and the like, thereby facilitating setup of the bed construction.

* * * * *